US008409067B2

(12) United States Patent
Cooper et al.

(10) Patent No.: US 8,409,067 B2
(45) Date of Patent: Apr. 2, 2013

(54) LEAFLET PRODUCTION

(75) Inventors: Michael John Cooper, Colchester (GB); Geoffrey Alan Giles, Oxfordshire (GB); Edward William Colvill, Suffolk (GB); Peter William Sevenoaks, Chobham (GB)

(73) Assignees: Digi Leaflet Technologies Limited, Colchester (GB); Vacuumatic Limited, Colchester (GB)

( * ) Notice: Subject to any disclaimer, the term of this patent is extended or adjusted under 35 U.S.C. 154(b) by 635 days.

(21) Appl. No.: 12/557,691

(22) Filed: Sep. 11, 2009

(65) Prior Publication Data

US 2011/0065561 A1 Mar. 17, 2011

(51) Int. Cl.
*B31F 1/10* (2006.01)

(52) U.S. Cl. ..... 493/424; 493/175; 493/434; 493/442; 493/454

(58) Field of Classification Search ..... 493/419, 493/424, 434, 442, 443, 454, 175
See application file for complete search history.

(56) References Cited

U.S. PATENT DOCUMENTS

| | | | | |
|---|---|---|---|---|
| 4,010,299 | A * | 3/1977 | Hershey et al. | 428/44 |
| 4,136,860 | A | 1/1979 | Shacklett, Jr. et al. | |
| 4,248,414 | A | 2/1981 | Rovin et al. | |
| 4,403,981 | A * | 9/1983 | Wuthrich | 493/419 |
| 6,908,661 | B2 * | 6/2005 | Green et al. | 428/178 |
| 7,247,129 | B2 * | 7/2007 | Neubauer et al. | 493/421 |
| 2006/0097444 | A1 * | 5/2006 | Spinetti | 271/216 |

FOREIGN PATENT DOCUMENTS

| | | |
|---|---|---|
| GB | 21575 | 0/1913 |
| GB | 1254850 | 11/1971 |
| GB | 1592879 | 7/1981 |

* cited by examiner

*Primary Examiner* — Thanh Truong
(74) *Attorney, Agent, or Firm* — Andrus, Sceales, Starke & Sawall, LLP

(57) ABSTRACT

A leaflet is produced from a pre-printed sheet of material by folding the sheet with at least one crease-line along the line of advancement of the sheet but preferably with two or more such crease-lines so that the sheet is fan-folded. The crease-lines are squeezed by a roller nip and then the sheet is fed into a diametral slot in a mandrel of elliptical cross-section. The leading edge of the sheet is gripped within the slot and then the mandrel is rotated to wind the sheet around the outer surface thereof. The wound sheet is then removed from the mandrel and is squeezed through a roller nip so as to form a substantially flat folded leaflet. The leaflet may be converted to a booklet by joining together the overlying sheets along one folded edge of the compressed leaflet and slitting open the other folded edge of the compressed leaflet.

31 Claims, 13 Drawing Sheets

20
35
37
36
33
34
12
16
15
14
13
23

20
35
37
36
34
33
34
13
15
23

LEAFLET PRODUCTION

BACKGROUND OF THE INVENTION a) Field of the Invention

This invention relates to apparatus for and methods of finishing a leaflet, and optionally a booklet, from plain, partially or wholly pre-printed sheet material, drawn from cut sheets or a reel.

b) Description of the Prior Art

Most commonly, it is necessary for a product manufacturer to impart information about the product to the end user. Sometimes sufficient information can be carried either on the product itself, but more often the information is printed on the packaging for the product or on a label adhered thereto. Where there is a requirement for a greater amount of information, it is the conventional practice to include a pre-printed information leaflet in the product packaging.

In the case of pharmaceutical products, country or market legislation requires the manufacturers to give the end users the specific information concerning the products and it is in general not possible to print all of that information on a cardboard carton containing one or perhaps a few blister strips, a tube of ointment, a small bottle of liquid or similar product. It is therefore the usual practice to fold a printed sheet, normally made from thin paper and carrying the required information, to a size sufficiently small to be inserted into the carton, along with the pharmaceutical product itself, or to be attached to a bottle containing the pharmaceutical product.

Rationalisation is creating specialist pharmaceutical manufacturing centres supplying global markets. The variations required to meet local regulations has increased packaging complexity—for example, the same medication may have to be packed to meet a large number of different national requirements, affecting the information leaflet and carton text content. Regulatory authorities are concerned to ensure an ageing population can both read and understand all patient information. More product data, larger type-faces and more user-friendly layouts increase the required space on a product leaflet. Furthermore, some countries require multi-language content which adds yet further pressure on the size of suitable leaflets, sometimes exceeding current information leaflet production capabilities.

Having regard to the above, there is a demand for leaflets of ever greater usable area but which may be folded down to a relatively small size, for packaging with small products. Further, particularly in the case of pharmaceutical products, it is most important that a leaflet carrying particular information is properly associated with the correct pharmaceutical product and packaging. To this end, it is particularly advantageous if the leaflet can be printed at the time of packaging of a product, so as immediately to be associated with the packaged product. Furthermore, it is also advantageous if the leaflet is in a form which may be adhered to the packaging and then opened out for reading, rather than folded into a shape convenient for insertion into the packaging.

Existing methods available for producing folded information leaflets, often referred to as "outserts", involve complex set-up procedures which add to the production cost and encourage large order volumes which may not reflect immediate demand. This often creates unnecessary packaging waste and affects the leaflet supplier's ability to offer an optimum logistics service.

A known leaflet production technique is described in U.S. Pat. No. 4,136,860 (Shacklett). FIGS. 6 to 9 of Shacklett show a cut sheet of paper pre-printed with the required information repeated on different areas of the sheet. That sheet is then wound around a cylindrical former of circular cross-sectional shape, removed from the former and squeezed into a substantially flat form. The wound sheet is then cut into separate pieces each containing all the required information; thereafter, each wound and squeezed piece may be attached to a carton or bottle. A disadvantage of this process is that the squeezing operation which is performed on the wound sheet causes significant distortion thereof, leading to the formation of unwanted creases. Further, each piece cut from the wound and squeezed sheet must have a significant length (in the direction of the axis of the former) in order to contain the required information in an easily readable form.

BRIEF SUMMARY OF THE INVENTION

In view of these various requirements, the present invention aims at providing both an apparatus for and a method of producing an information leaflet from a plain or pre-printed sheet provided in cut form or drawn from a reel, which leaflet is particularly suitable for use with pharmaceutical products but also useful whenever information leaflets are to be packaged with products.

According to this invention, there is provided apparatus for producing a leaflet from a sheet, comprising:

- a mandrel having an axis and outer surface of generally elliptical cross-sectional shape, the mandrel being mounted for rotation about said axis;
- a gripper provided on the mandrel to hold a leading end portion of a pre-printed sheet fed to the mandrel;
- a drive arrangement to effect rotation of the mandrel about said axis so that a gripped sheet is wound around the outer surface of the mandrel as the mandrel is rotated by the drive arrangement;
- an extractor for removing from the mandrel the sheet wound therearound; and
- a compression arrangement to compress the extracted wound sheet into a substantially flat leaflet.

According to a second but closely related aspect of this invention, there is provided a method of producing a leaflet from a pre-printed sheet, comprising the steps of:

- feeding the sheet to a mandrel having an outer surface of generally elliptical cross-sectional shape and a gripper associated therewith;
- using the gripper to hold to the mandrel a leading edge of a fed sheet;
- rotating the mandrel about the axis thereof so as thereby to wind the fed sheet around the outer surface of the mandrel;
- removing a wound sheet from the mandrel; and
- compressing the wound sheet into a substantially flat leaflet.

Both the apparatus and method of this invention may be modified so as to have a booklet as the end product, from a leaflet produced in accordance with this invention. This may be achieved by bonding together the sheets of the leaflet along one edge of the compressed substantially flat leaflet and slitting or cutting at least the opposed edge of that leaflet, and possibly also the two adjacent sides of the leaflet.

It will be appreciated that a leaflet produced from a sheet in accordance with this invention may have a relatively large printed area and yet be produced in an efficient and rapid manner. As the sheet is wound around a mandrel having a generally elliptical cross-section, the degree of compression of the wound sheet required to produce a flat leaflet is reduced, which in turn reduces the likelihood of a creased or misshapen leaflet, especially when a large information area is required.

BRIEF DESCRIPTION OF THE SEVERAL VIEWS OF THE DRAWINGS

The drawings show various specific embodiments of apparatus for producing a leaflet or booklet and methods of producing the same, all in accordance with this invention, though solely by way of example. In the drawings.

DETAILED DESCRIPTION OF THE INVENTION

Figure 1:
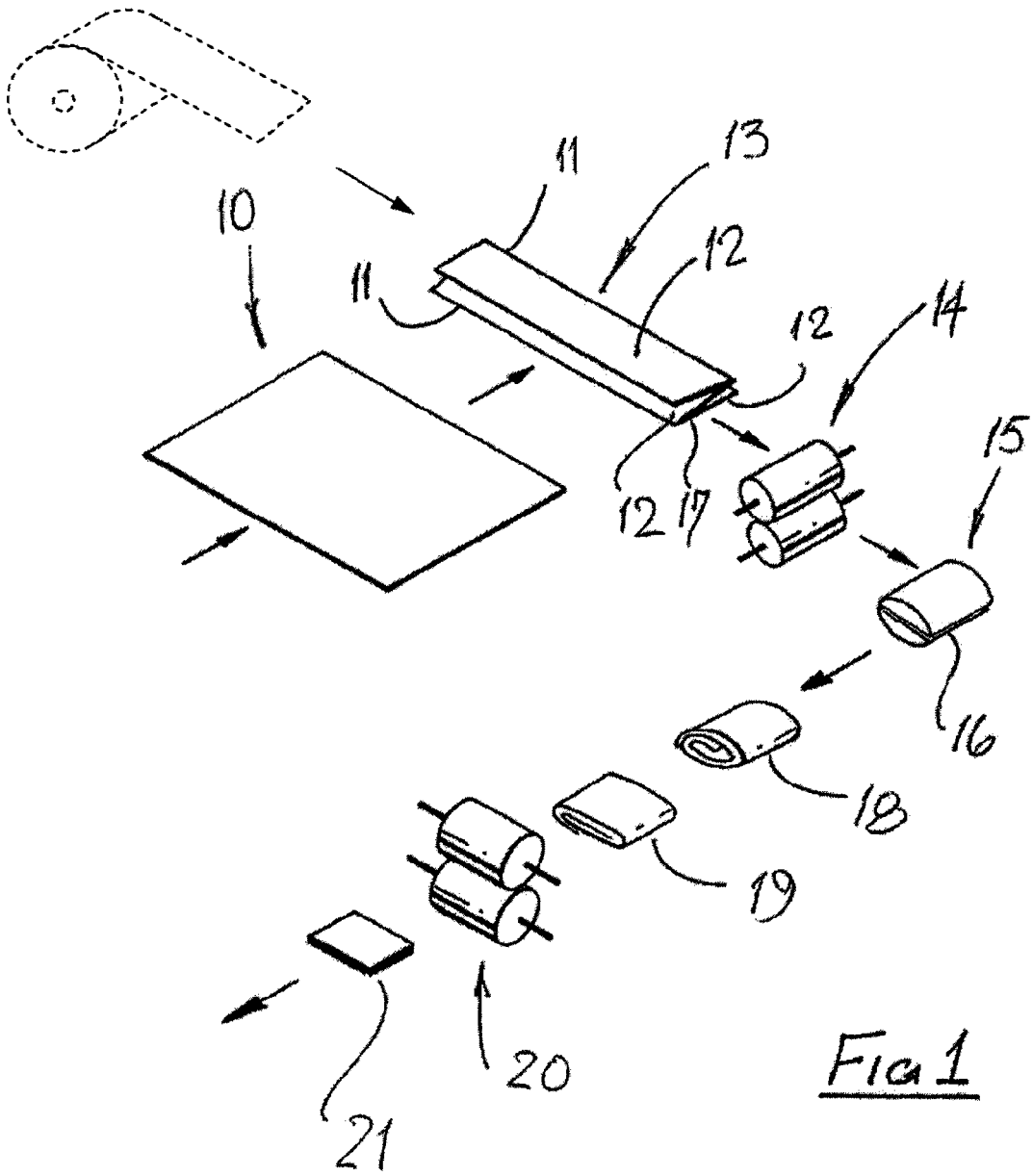
FIG. 1 diagrammatically illustrates the process performed by either embodiment of machine.

The sheet used for producing the leaflet is pre-printed and may be printed on-line, either immediately or shortly before the sheet is to be folded into a leaflet and associated with a product. The apparatus allows the use of digital printing technologies to pre-print a cut or reel-fed sheet, which is then formed into a leaflet. The leaflet may be applied to a package or carton, immediately following the leaflet formation.

In a particularly preferred method of this invention, the sheet is pre-folded along at least one crease-line, but preferably along two or three crease-lines, extending parallel to the direction of advancement of the sheet towards the mandrel. For example, in the case of a cut sheet of A4 size or other similarly-proportioned size, the creases would extend parallel to the long edges of the sheet and advantageously divide the sheet into three or four panels of substantially equal area. Such folding of the sheet may be performed by means of a plough folder or other known folding apparatus, to form the fan-folded or internally folded sheet. Once folded, the sheet may be compressed, for example by a roller nip, fully to form the crease-lines in the sheet. The nip may also perform the function of controlling the feeding of the sheet to the mandrel.

On winding such a folded sheet around the mandrel, the sheet panel on the mandrel surface will be wound around a smaller radius than the sheet panel furthest from the mandrel, due to the thickness of the sheet. This could tend to form creases in the sheet during the winding operation, especially where the sheet is long, but to minimise the likelihood of this, it is important that the sheet is both relatively thin and also smooth, so as to have a relatively slippery surface. To this end, it is preferred for the sheet to be of a thin opaque non-paper material, such as a plastics material, rather than paper as used in the production of traditional or smaller leaflets.

The method of this invention may be performed on cut sheets or on a roll-fed web of sheet material, but in the latter case the material must be cut at some point in the process before winding of the material on the mandrel has been completed, to allow the production of separate leaflets.

A preferred apparatus has a mandrel with a slot formed therein, and into which the leading edge of the folded sheet is received. That slot may extend fully across the mandrel, preferably along the major diameter of the generally elliptical cross-section. Within the mandrel, there may be provided a clamping arrangement, for example including a movable gripper finger, arranged to hold a leading edge portion of a sheet received within that slot and thereafter to allow winding of the sheet around the mandrel.

The wound sheet may be removed from the mandrel either by holding the wound sheet stationary and pulling the mandrel axially out of the wound sheet, or by holding the mandrel stationary and pulling the wound sheet off the mandrel. In either case, a pair of endless belts carried on arms movable towards and away from each other and arranged to embrace the mandrel, may be provided for this purpose. Where the mandrel is moved axially out of the wound sheet, those arms may extend in a direction generally normal to the axis of the mandrel. In this case, the belts may also serve to assist the winding of the sheet around the mandrel, by having the belts initially contacting the outer surface of the mandrel, and then contacting the sheet as winding progresses, on rotation of the mandrel. Where the mandrel is held stationary and the wound sheet is pulled off the mandrel, the arms may extend in a direction generally parallel to the axis of the mandrel and remain clear of the mandrel until the wound sheet is to be pulled off.

In either of the above cases, the belts may define a narrowing gap therebetween, whereby movement of the wound sheet between the belts performs an initial compression of the wound sheet removed from the mandrel. Further compression of that wound sheet into the finished leaflet may be performed by a roller nip furnished at the exit of the narrowing gap of the belts. An adhesive applicator may be provided adjacent the exit of the narrowing gap or the roller nip for performing final compression of the leaflet so as to adhere the free end of the wound sheet to the body of the leaflet.

When a booklet is to be produced from a leaflet resulting from performance of this invention, glue may be applied during the winding of the sheet around the mandrel, along a location which will form an edge of the finished leaflet. Normally, this will be along a part of the elliptical mandrel furthest from the origin of the ellipse—that is to say, furthest from the axis of rotation of the mandrel. This may be achieved automatically by placing a glue applicator in the path of the periphery of the mandrel such that when the part of the mandrel passes over the applicator, glue is applied to the sheet being wound.

As the leaflet is wound round the mandrel, the glue is applied only to the outer surface of the multi-layer pre-folded leaflet material. That material may be provided with small holes or perforations along the same line as the glue application, in order to ensure the glue reaches the inner layers. In the case of a non-paper material, a heat sealing process for bonding together the layers which will form the leaves of the booklet may be more efficient than the use of glue and perforations.

Subsequently, on compression of the leaflet, the glued edge regions of the wound and compressed sheet adhere together so as to form a spine for the booklet. The opposed edge of the wound and compressed sheet, forming the leaflet, is then subjected to a slitting or three knife cutting operation such that a booklet with a plurality of leaves adhered at the spine is thereby formed.

The method may employ a pressure sensitive adhesive (glue) or a heat sensitive adhesive. In the case of the former, the compression of the leaflet may serve to adhere together the sheets along the compressed edge of the leaflet. In the case of the latter, the compressed edge of the leaflet may be subjected to a heating step, for example by being passed through a nip including a heated wheel bearing on the glued edges. In an alternative process using a plastic material sheet, no adhesive may be required, as a sufficient bonding may be achieved merely by heating the plastic material.

Referring now to the drawings, these show preferred arrangements of apparatus and methods of this invention which will be described in detail in the following.

The sequence of producing a leaflet in accordance with this invention from a cut sheet of paper or similar thin opaque non-paper material is shown in FIG. 1. A cut sheet 10, pre-printed with information, is fan-folded for example by a plough-folding operation, to have two creases 11 extending parallel to the length of the sheet, so as to divide the sheet into three panels 12 of substantially the same shape and area. The sheet may instead be folded by other known processes, such as roll-folding, to have a required folded format. The folded sheet 13 is passed through a roller nip 14 so as fully to form the creases 11 and also to control feeding of the folded sheet 13 towards a mandrel 15.

Rather than using cut sheets, the sheet may be drawn from a reel and then cut during the leaflet production process. Such a reel feed is shown in phantom lines in FIG. 1.

In this embodiment, the mandrel 15 has a regular elliptical shape as shown in FIG. 1, with a slot 16 extending through the mandrel, perpendicular to the major axis of the elliptical shape. A clamping device is provided within the slot in the mandrel so as to permit the gripping of the leading edge of a folded sheet 13 fed into the slot 16, by the roller nip 14. The mandrel is mounted for rotation about its geometric centre, in a timed relation to the feeding of a folded sheet into the slot 16, such that when the leading edge 17 of a folded sheet 13 has been fed sufficiently into the slot 16 and then clamped there, the mandrel is rotated so as to wind the folded sheet around the outer surface of the mandrel.

Once the full length of the folded sheet has been wound round the mandrel 15, the wound sheet 18 is slid off the mandrel in the axial direction thereof and is squeezed to form a flattened coil 19. That coil is then passed through a further roller nip 20 to form creases in the flattened coil and so result in the finished leaflet 21, ready for application to a product either immediately or at some time subsequently.

Figure 2:
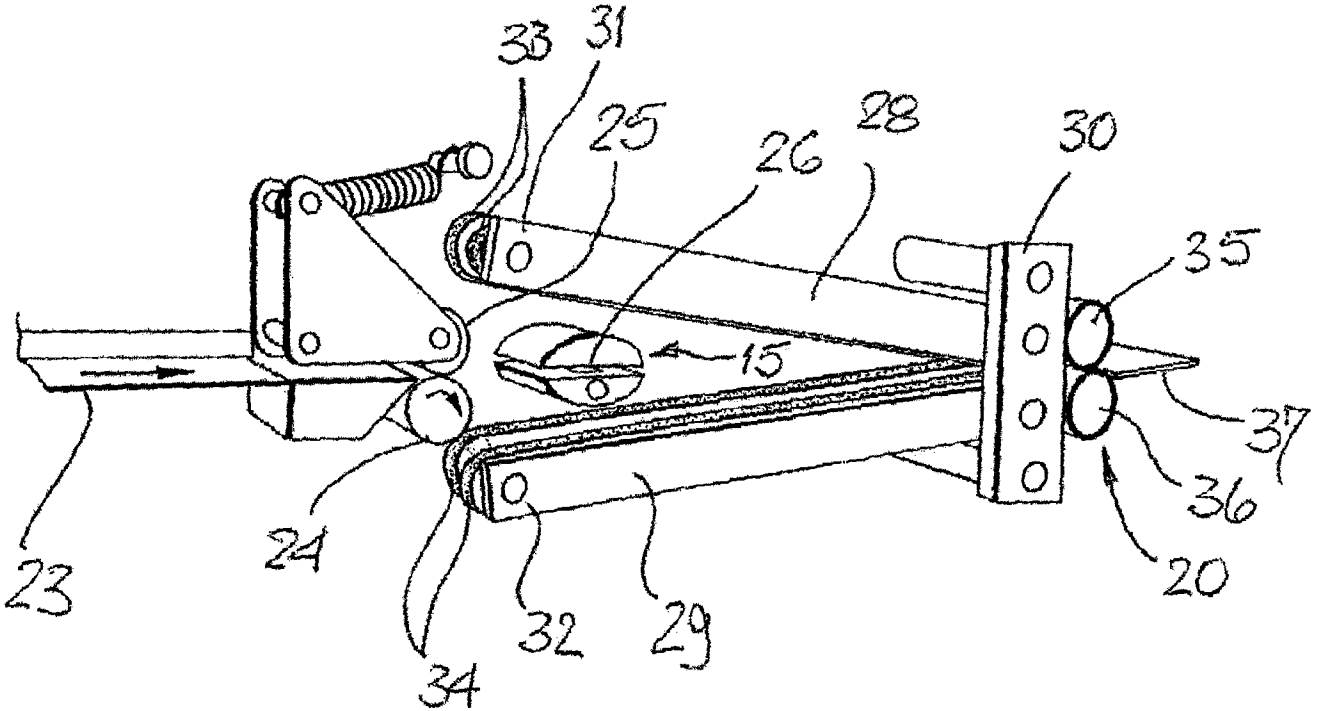
FIG. 2 is a perspective view of the important parts of the first embodiment of leaflet producing machine arranged to perform the process of FIG. 1.

FIG. 2 diagrammatically illustrates a machine arranged to perform the above process steps, and FIGS. 3 to 7 show those processing steps performed by the machine and corresponding to the steps shown in FIG. 1. A guide 23 for a pre-printed folded sheet leads to the roller nip having a fixed roller 24 and a moving roller 25 spring-urged into engagement with the roller 24. A stepper motor drive (not shown) is provided for the fixed roller 24 in order to control the advancement of a sheet fed into the nip.

The mandrel 15 is formed in two similarly-profiled parts mounted on a rotatable carrier (not shown), with the slot 16 (in FIG. 1) formed between those parts. A gripper finger 26 is mounted within the lower part (in FIG. 2) for movement into and out of the slot 16, towards and away from the upper part, by means of a control arrangement extending through the carrier to an external actuator (also not shown). In this way, the leading edge region of a sheet fed into the slot may be gripped within the slot.

A pair of arms 28,29 are pivoted to a mount 30 so that the arm ends 31,32 may be moved towards and away from each other with the arms shown in FIG. 2 separated to the maximum extent. Each arm carries a pair of belts 33,34 respectively, running around pulleys provided at both ends of each arm and a stepper motor drive (not shown) is provided for each of those pairs of belts. A spring (not shown) is arranged to urge the arm ends 31,32 towards each other and a control mechanism (also not shown) for those arms 28,29 is adapted to hold the arms separated, as shown, or to allow the spring to act on the arms so that the belts 33,34 contact the outer surface of the mandrel.

Adjacent the mount 30, on the side thereof remote from the arms 28,29, is the further roller nip 20, comprising rollers 35,36. One of those rollers may be fixed with the other spring urged towards the fixed roller, in a manner generally similar to that of roller nip 14. A stepper motor is arranged to rotate the fixed roller, when required.

Figures 3, 4:
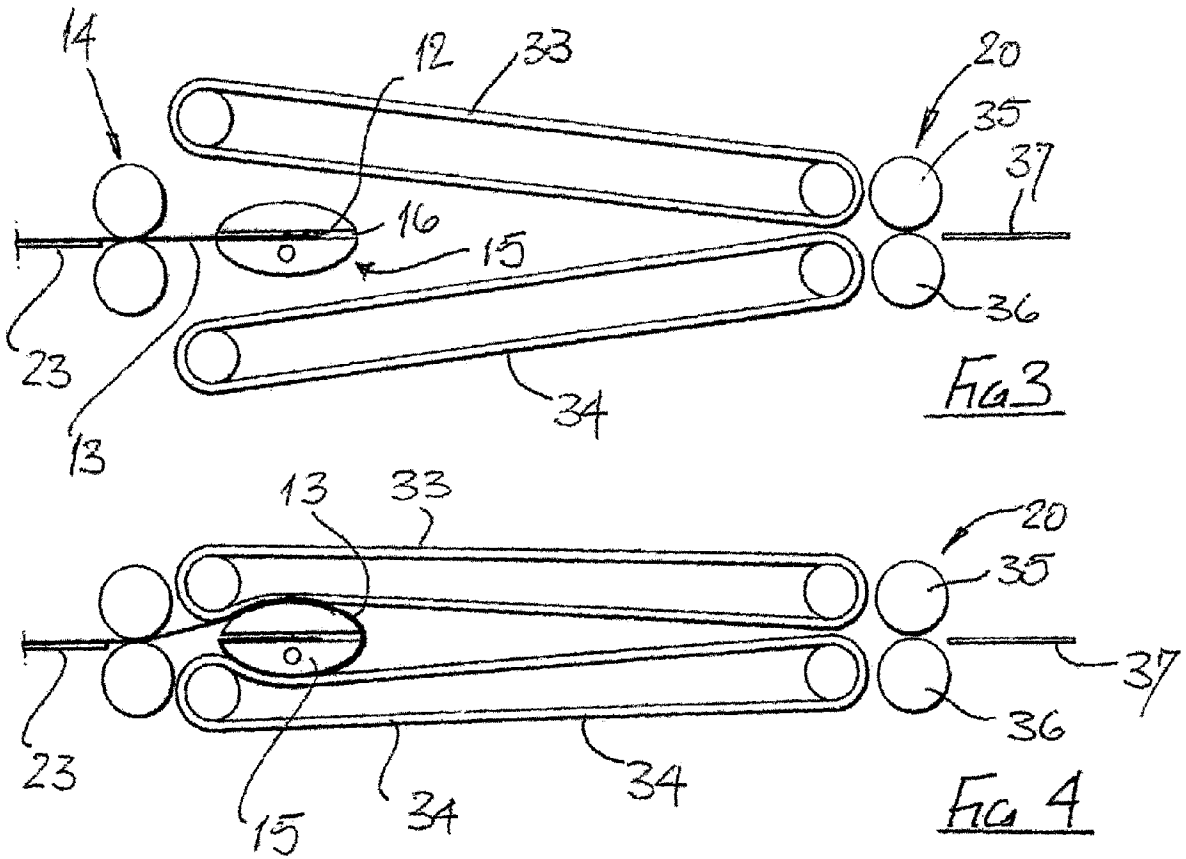
FIGS. 3 to 7 are side views of the machine of FIG. 2, showing the sequence of operation of the machine in producing a leaflet.

The first stage of the operation of the machine of FIG. 2 is shown in FIG. 3. A pre-printed folded sheet 13 is shown fed through the roller nip 14 into the slot 16 and is being gripped by finger 26, moved to its active position. Once gripped in this way, the arms 28,29 are released so as to be moved towards each other by the associated spring until the belts 33,34 contact the outer surface of the mandrel 15. The mandrel is then rotated so that the fed sheet is wound around the outer surface of the mandrel, with the arms moving apart and closer together as required, to accommodate the changing effective diameter of the mandrel. FIG. 4 shows the operation with one full turn on the mandrel, so that the folded sheet is being wrapped around the outer surface of the mandrel.

Figure 5:
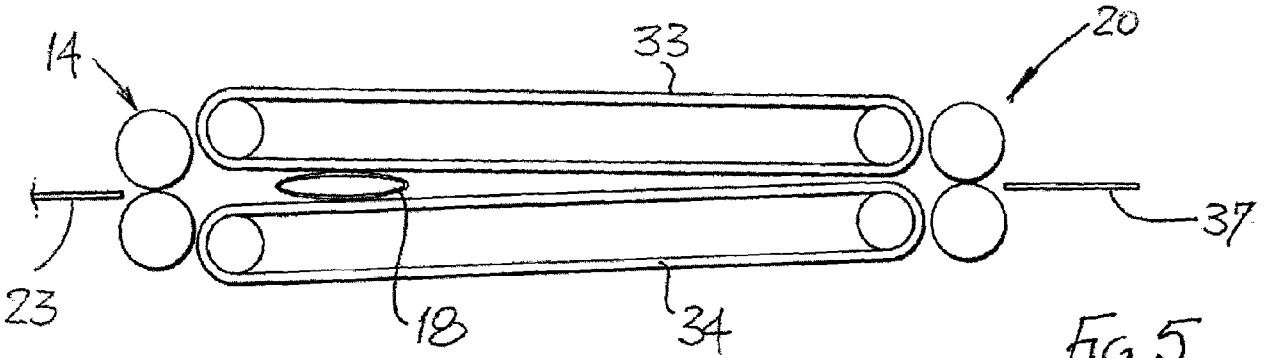
Figure 6:
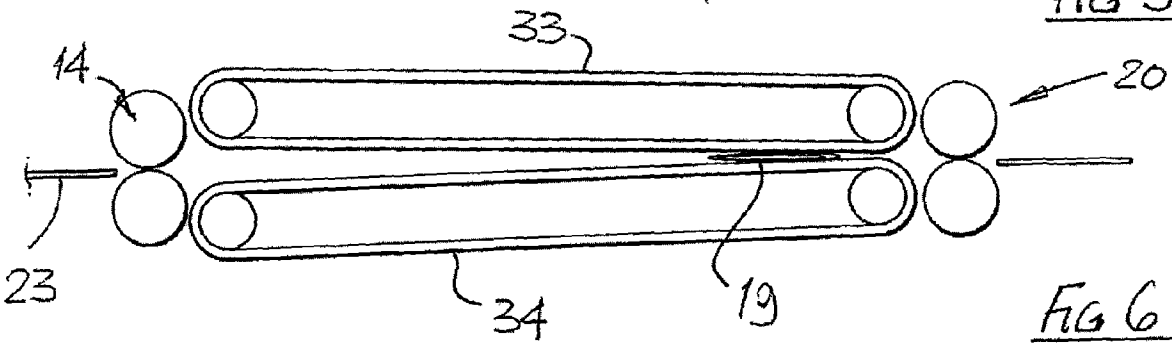
Figure 7:
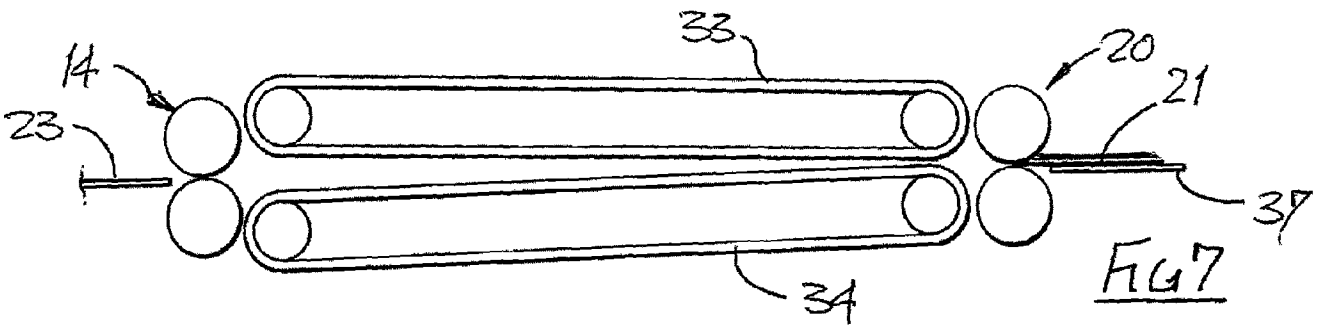

Once the folded sheet has fully been wound around the mandrel, the mandrel is retracted in the axial direction while the wound sheet 18 is held stationary by the belts 33,34, until the mandrel comes free of that wound sheet 18, as shown in FIG. 5. The mandrel itself has not been shown in FIG. 5, for the sake of clarity, but it will be understood that the mandrel has been moved backwards in the direction out of the plane of the drawing. The belts 33,34 are then driven to move the wound sheet to the right (in FIG. 6) so as to form a flattened coil 19, as the sheet approaches the exit end of the arms 28,29. Continued operation of the belts feeds the flattened coil 19 between the rollers 35,36 of the further nip 20. As the flattened coil passes through that nip on to an exit guide 37, the coil is creased so as to form the finished folded leaflet, ready for attachment to a product.

It will be appreciated that the location of the trailing edge of the flattened and creased coil relative to the creases of that coil may be adjusted by controlling the distance within the slot 16 that the leading edge of the folded sheet is fed, before rotation of the mandrel commences. The important requirement is that the folded sheet is gripped by the finger 26 to prevent any significant slippage of the sheet on rotation of the mandrel; it would be possible for the leading edge to project beyond the slot, should the length of the sheet warrant that to have the trailing edge in the required disposition relative to the creases of the coil. Conveniently, the trailing edge of the finished leaflet should project slightly beyond a crease, so as to provide a tab for opening-out the leaflet, once attached to a product.

Instead of the slot 16 and gripper finger 26, the mandrel may be provided with an alternative gripping arrangement to hold the leading edge of the folded sheet to the outer surface of the mandrel.

Figure 8:
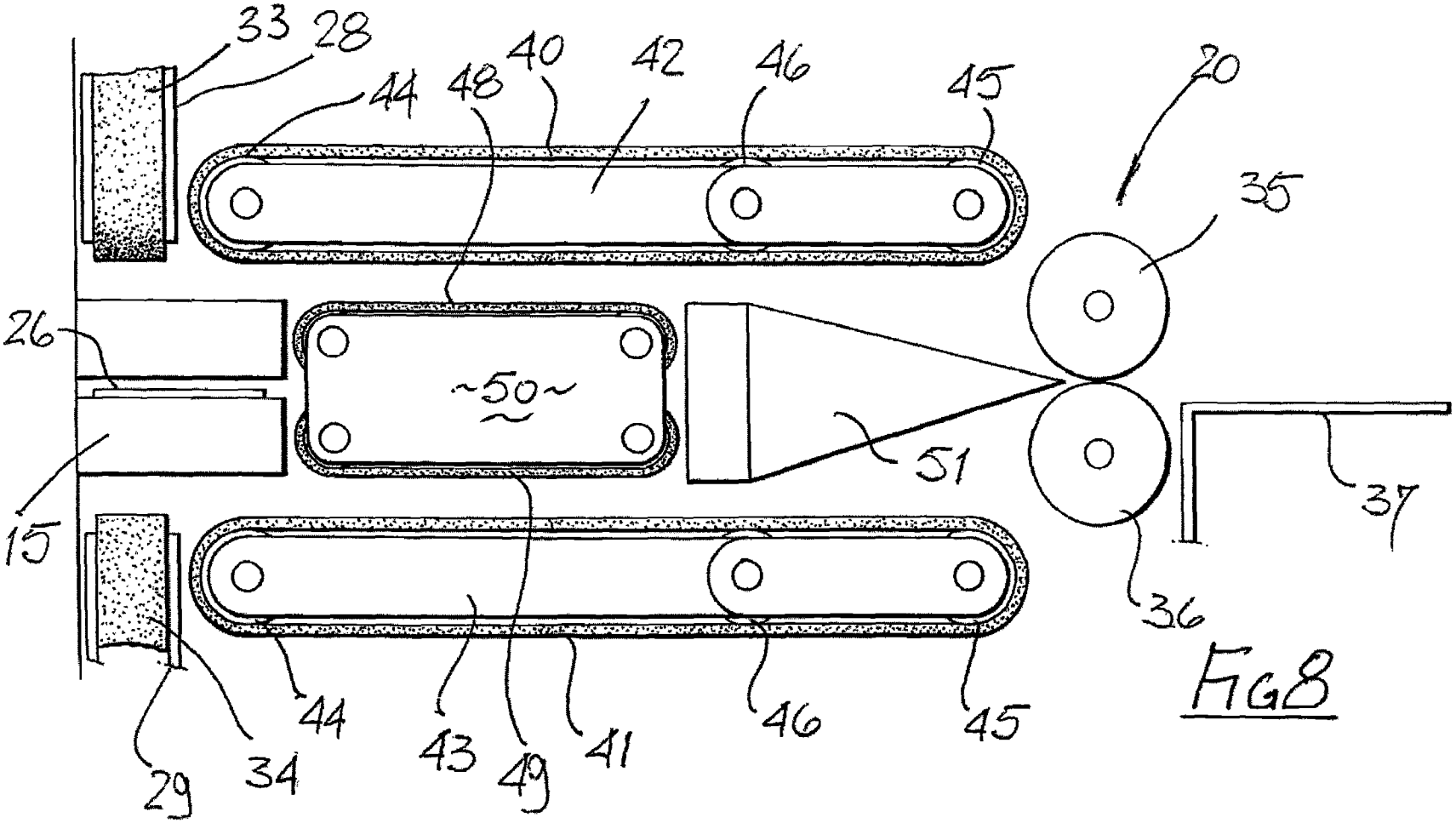
FIG. 8 is a side view diagrammatically illustrating the important parts of the second embodiment of the leaflet producing machine, also arranged to perform the process of FIG. 1.
Figure 9:
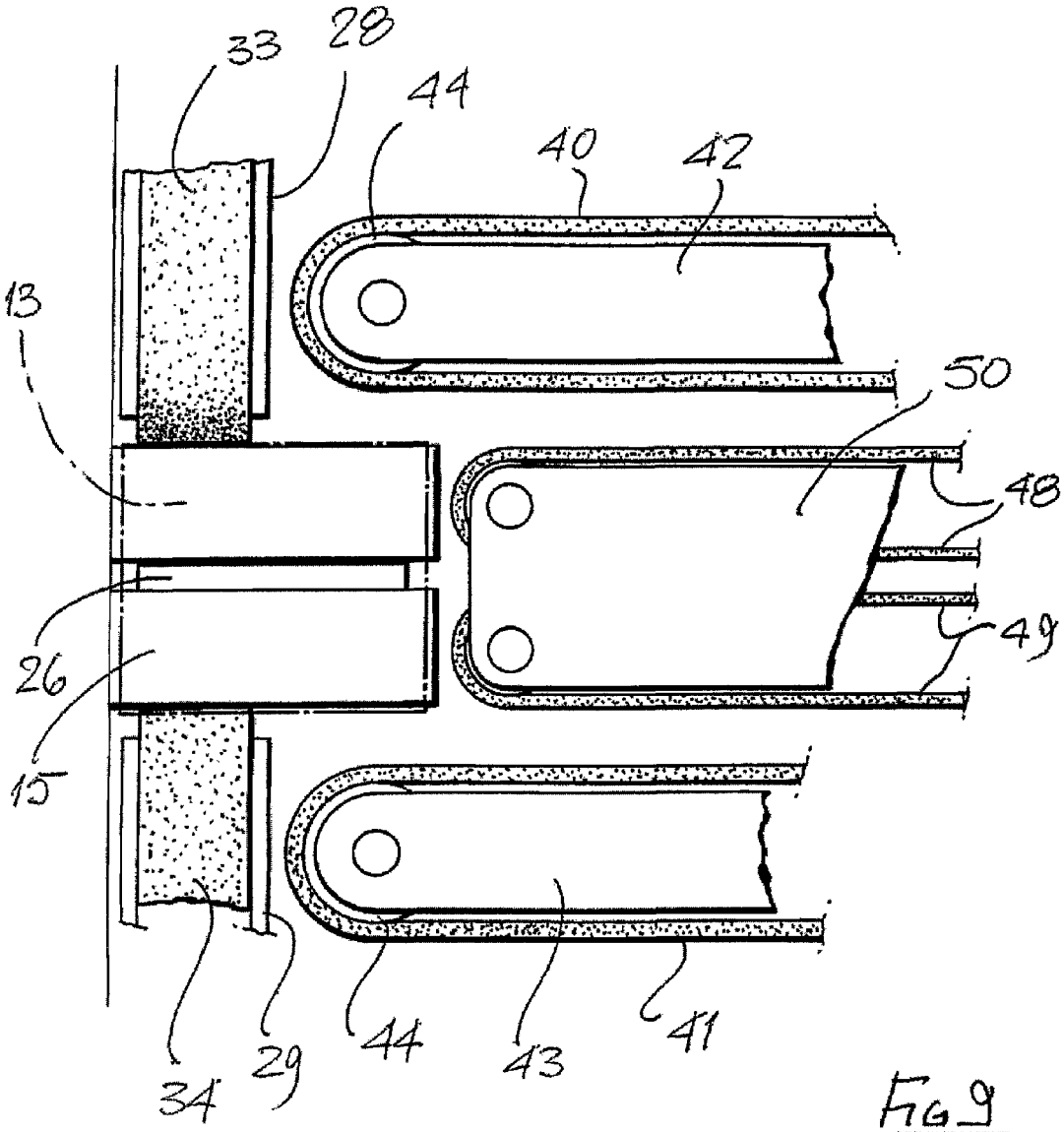
FIGS. 9 to 12 are views generally corresponding to that of FIG. 8, but showing the sequence of operation of the machine of FIG. 8, in producing a leaflet.

FIGS. 8 to 12 show an alternative embodiment of machine for producing a leaflet by the process of this invention, but which embodiment eliminates the axial movement of the mandrel following winding of a folded sheet therearound. In this embodiment, the mandrel 15 corresponds to that described above, except that the carrier (not shown) for the mandrel parts is axially fixed. Further, each arm 28,29 is significantly narrower than with the first embodiment and carries only a single belt 33,34. The arms are arranged closely adjacent the carrier for the mandrel and have a width of less than half the axial length of the mandrel, as shown in FIGS. 8 and 9.

A pair of removal belts 40,41 are mounted on respective carriers 42,43 to run around end rollers 44,45 rotatably mounted on those carriers. Each carrier is articulated part way between its ends and an idler roller 46 is rotatably mounted at that articulation. A drive arrangement (not shown) is provided for each removal belt 40,41 and a control mechanism (also not shown) is arranged to move the carriers 42,43 with the removal belts 40,41 between their separated position shown in FIG. 8 and their removal position shown in FIGS. 10 and 11, as required during the operation of the machine.

Mounted between the removal belts 40,41 is a pair of idler belts 48,49 running around respective rollers supported on plates 50, held stationery between the carriers 42,43. A wedge-shaped former 51 is disposed at the end of the plates 50 remote from the mandrel 15 and leads to the further roller nip 20 having rollers 35,36 together with a drive arrangement (not shown). As with the first embodiment, an exit guide 37 is provided downstream of the further roller nip 20.

The initial operational steps of this second embodiment is as described above, with reference to the first embodiment. Once a folded sheet has been fed into the slot 16 between the mandrel parts and then gripped by the finger 26, the arms 28,29 are released to be moved under the spring force to contact the mandrel (FIG. 9). The mandrel is then rotated, so as to wind the folded sheet therearound, as described with reference to the first embodiment, with the arms separating and moving closer as necessary to accommodate the varying diameter of the mandrel, therebetween.

Figure 10:
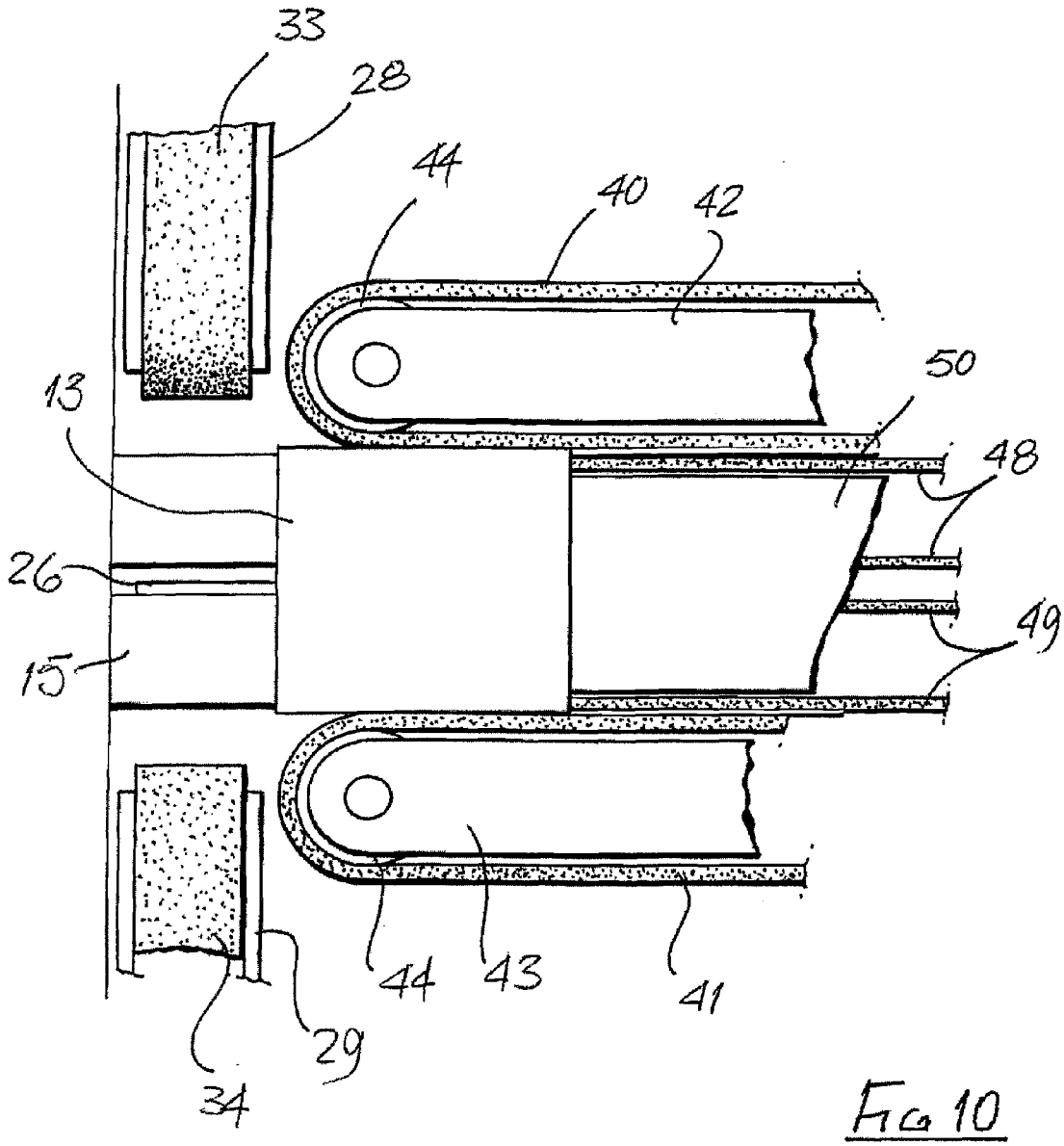
Figure 11:
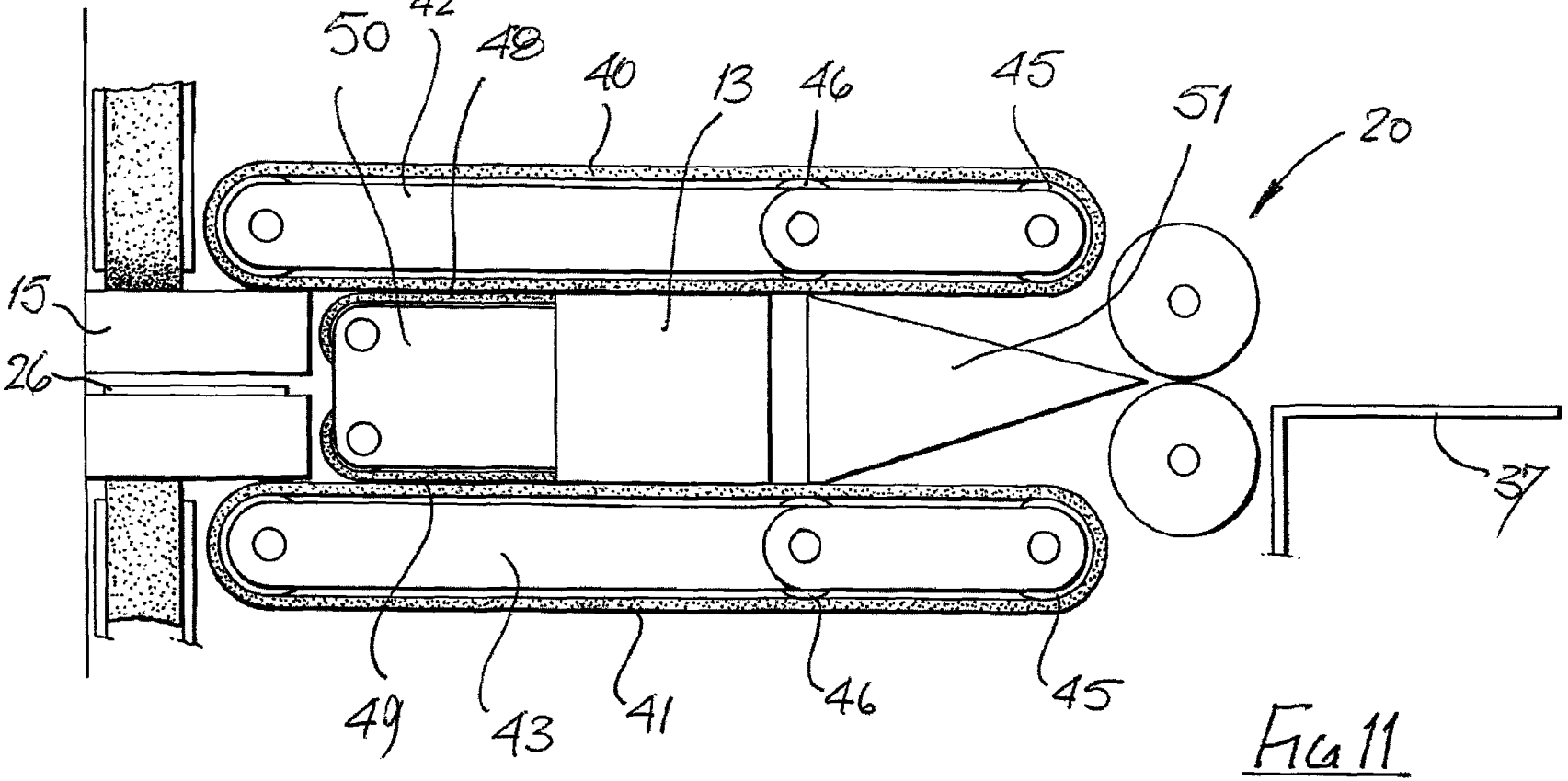
Figure 12:
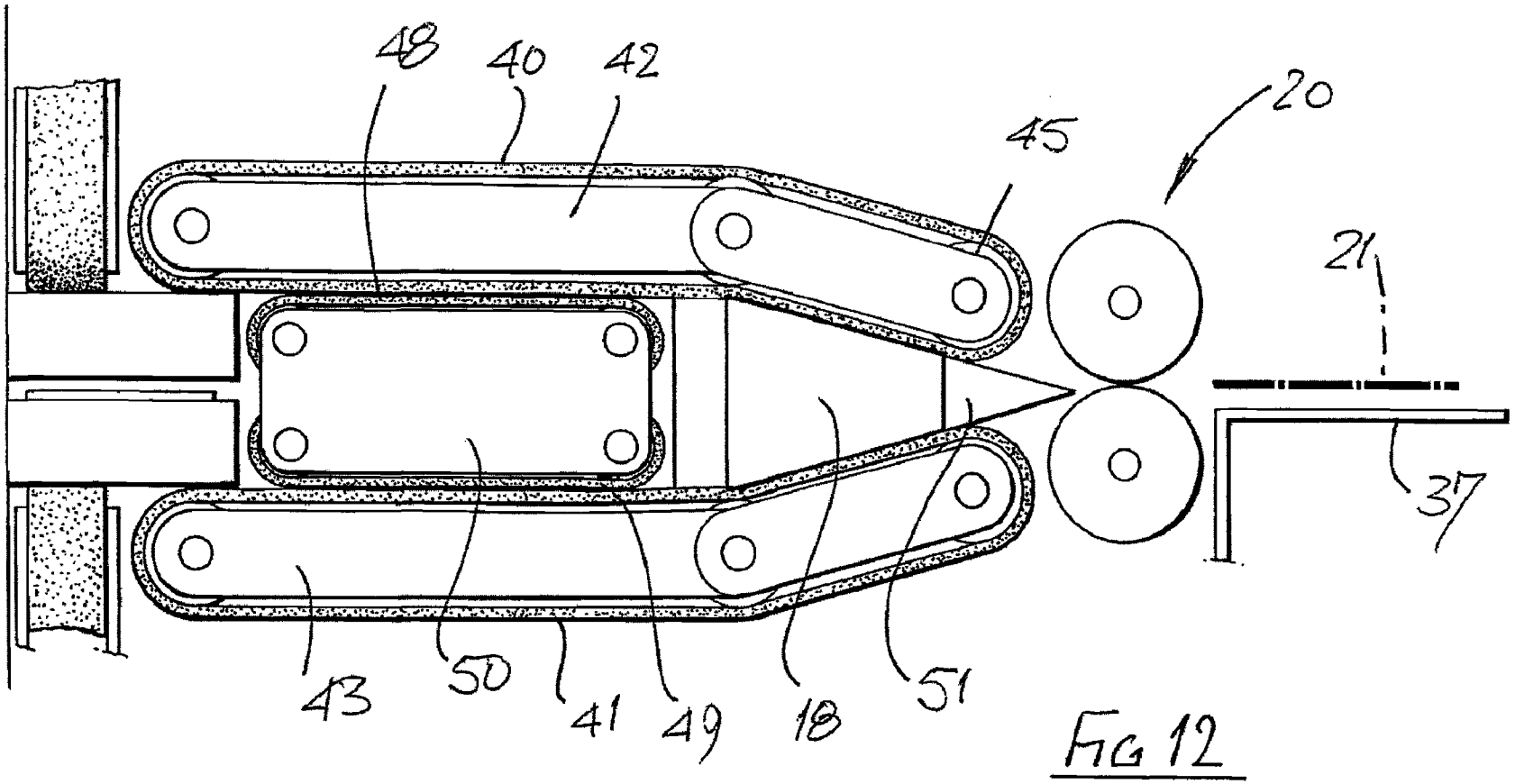

Once the folded sheet has been fully wound around the mandrel the arms 28,29 are moved apart, clear of the wound sheet, and the carriers 42,43 are moved closer together so that the removal belts 40,41 contact the wound sheet 18. Driving of those removal belts then pulls the wound sheet off the mandrel, to be engaged between the removal belts 40,41 and the idler belts 48,49 (FIG. 10). Continued operation of the removal belts pulls the wound sheet to the right (as shown in FIG. 11) until the wound sheet starts to overlie the former 51. The rear parts of the carriers 42,43 are then moved closer together as shown in FIG. 12 and continued operation of the removal belts 40,41 squeezes the wound sheet 18 into a flattened coil, by the interaction of those belts with the former 51. The squeezed wound coil is then passed through the further roller nip 20, to compress the creases in the flattened coil and form the finished leaflet 21.

It will be appreciated that from an engineering perspective, the machine illustrated in FIGS. 8 to 12 would be very difficult to manufacture and special support arrangements would have to be provided for the plates 50 and wedge-shaped former 51. Though an alternative engineered solution would have to be provided for a practical machine, nevertheless the principle of operation is adequately illustrated by this second embodiment.

Though not shown in the drawings, the machine may include an adhesive applicator provided before the final squeezing by further roller nip 20, to allow sealing of the end part of the wound sheet to the body of the leaflet. This will prevent inadvertent unwinding of the leaflet.

Figure 13A:
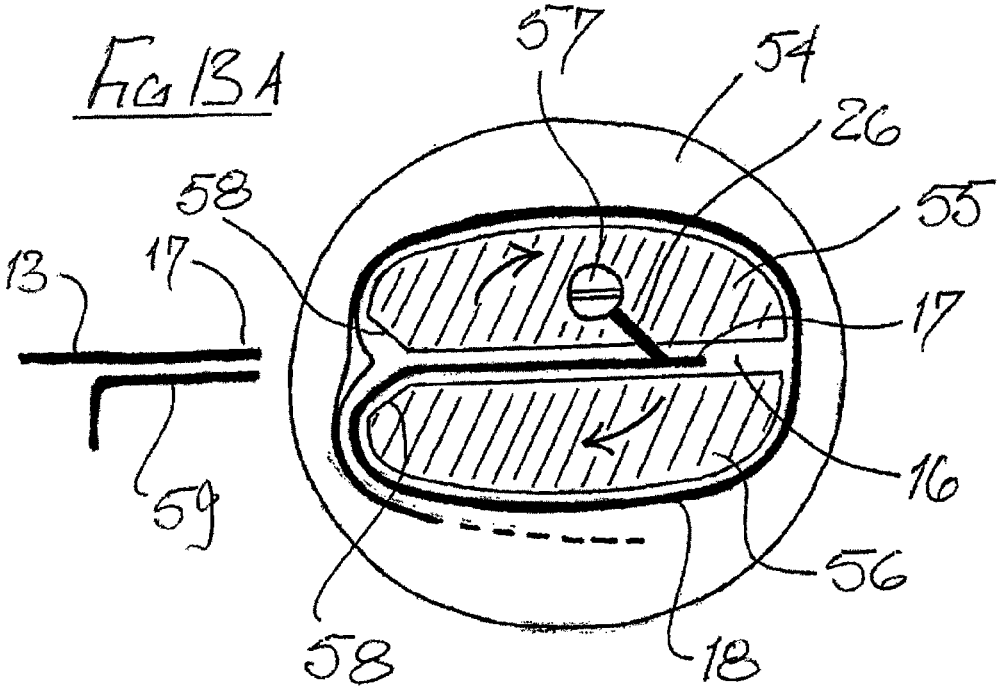
FIGS. 13A and 13B diagrammatically illustrate two alternative forms of mandrel for use in either of the embodiments.
Figure 13B:
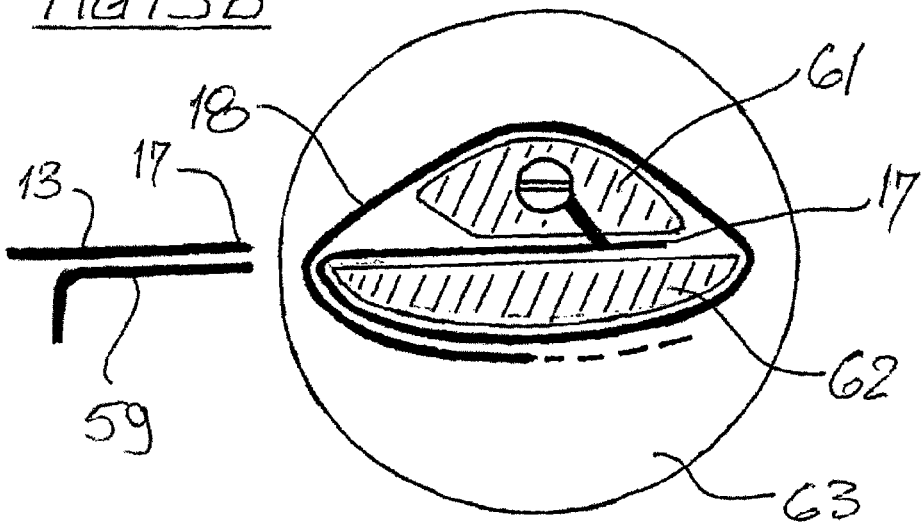

FIGS. 13A and 13B are cross-sections through two alternative mandrel designs, for use in either embodiment of machine as described above. The mandrel shown in FIG. 13A is substantially as shown in the embodiments of machine as described above and has a shape which is essentially symmetrical about the plane of the slot 16. The mandrel has a back plate 54 mounted for rotation about its axis and supports upper and lower mandrel parts 55,56. The gripper finger 26 is mounted in the upper part 55 on a shaft 57 such that the end of the finger remote from the shaft may be moved into and out of the slot 16. FIG. 13A shows the mandrel in its initial and final positions; the entrance to the slot 16 is bevelled at 58 to assist the entry of the leading edge 17 of a folded sheet 13 to be wound into a leaflet, the folded sheet 13 being fed to the mandrel along an in-feed table 59. FIG. 13A shows a sheet 18 wound fully around the mandrel, ready to be removed therefrom following release of the gripper finger 26.

FIG. 13B shows an alternative form of generally elliptical mandrel, defined by upper and lower mandrel parts 61 and 62 again supported on a back plate 63. The lower part 61 has a relatively small minor radius as compared to the major radius, such that the elliptical shape defined thereby is relatively flat. The upper part 63 in effect comprises a truncated form of the upper part 55 of the mandrel of FIG. 13A and defines the maximum minor radius around which the sheet 18 is wound. The advantage of this mandrel is that it is possible to change the lower part 62 for another of a slightly different shape, without disturbing the gripper finger 26 and its associated mechanism. In turn, this allows a different length of sheet to be wound around the mandrel, on each full turn thereof. In this way, the mandrel may readily be adjusted to suit different leaflet lengths.

In the foregoing description of FIGS. 13A and 13B, reference is made to the mandrel as having upper and lower parts but this is merely for convenience, having regard to the mandrel as illustrated in those drawings. The mandrel is mounted for rotation about the axis of the back plate 54 though FIGS. 13A and 13B show the mandrel in its initial and final positions, before commencing the winding of a folded sheet and subsequent to the completion of that winding.

Figure 14:
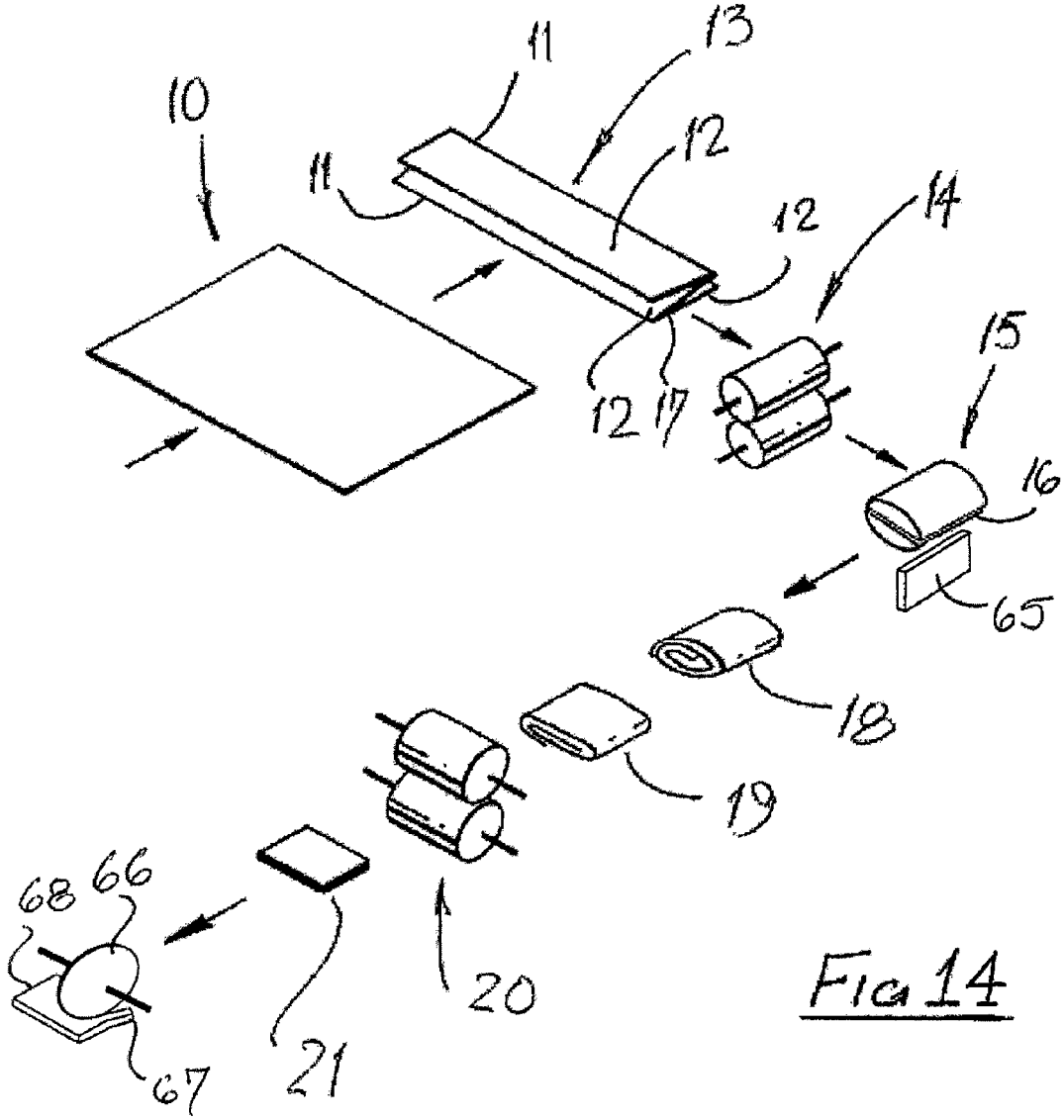
FIG. 14 illustrates a modified form of the apparatus of FIG. 1, arranged to produce a booklet.

FIG. 14 shows the process of FIG. 1 but modified for producing a booklet. Like parts with those of FIG. 1 are given like reference characters and will not be described again here. In FIG. 14, there is shown a glue applicator 65, disposed to lie parallel to the axis of rotation of the mandrel 15 and positioned so that as the mandrel 15 rotates and the major axis of the elliptical cross-section passes over the glue applicator, the glue applicator applies glue to a sheet being wound by the mandrel.

Figure 15A:
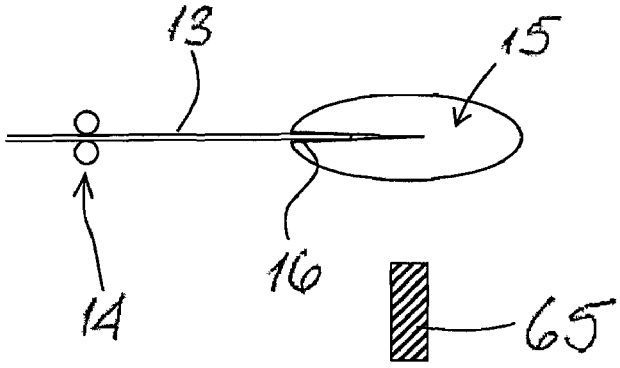
FIGS. 15A to 15E show the winding step for the apparatus of FIG. 14.
Figure 15B:
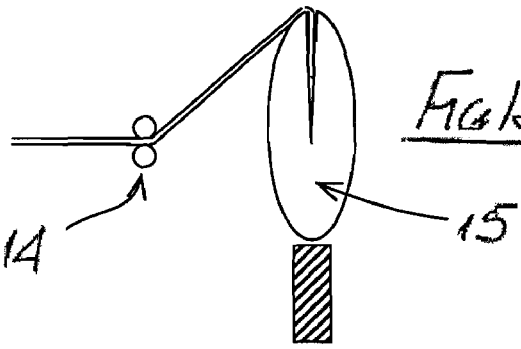
Figure 15C:
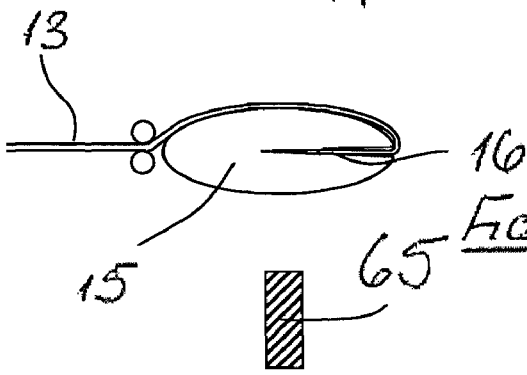
Figure 15D:
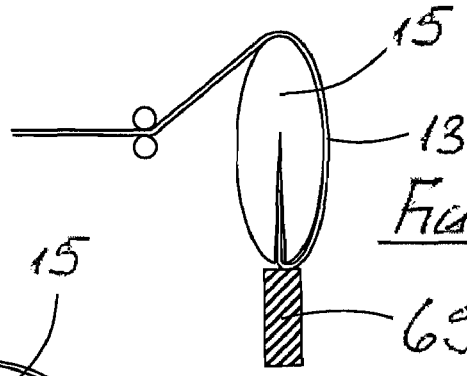
Figure 15E:
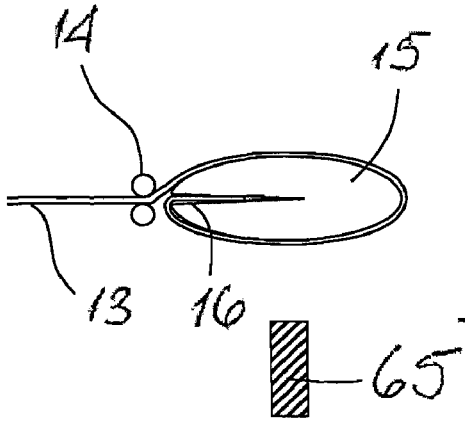

The application of glue is shown in more detail in FIGS. 15A to 15E. FIG. 15A shows the first stage of the leading edge 17 of a sheet being received in the slot 16 of the mandrel. Once gripped, the mandrel is rotated in a counter-clockwise direction and as the mandrel reaches 90° from its initial position (FIG. 15B), the sheet is wiped against the glue applicator 65. The mandrel continues to rotate through 180° from its initial position (FIG. 15C) and on turning a further 90° (FIG. 15D), adhesive is again applied to the sheet. A further 90° rotation (FIG. 15E) takes the mandrel back to its starting position but with the sheet wrapped around the mandrel one full turn.

The glue applicator 65 may take the form of a blade for applying the adhesive to the sheet, or it could be a roller which bears upon the sheet as the sheet is turned with the mandrel. In order to prevent adhesive being applied to the sheet at both ends of the major diameter of the elliptical cross-sectional shape, the applicator may be mounted for movement towards and away from the axis of rotation of the mandrel, in a timed relationship to that rotation such that the applicator is removed from the mandrel as the slot 16 passes thereover.

Following sufficient winding of the sheet, it is compressed by the further roller nip 20 to produce a finished leaflet as described above but with either one edge or both edges thereof adhered together, dependent upon whether the glue applicator 65 is fixed or mounted for movement in a timed relationship to the rotation of the mandrel. Either way, one edge of the leaflet passes under a slitter 66 which cuts away the edge margin 67 of the compressed leaflet. Once done, a booklet results with the opposed edge margin 68 forming a glued spine for the booklet and the pages being free to be opened.

Figures 16A, 16B, 16C:
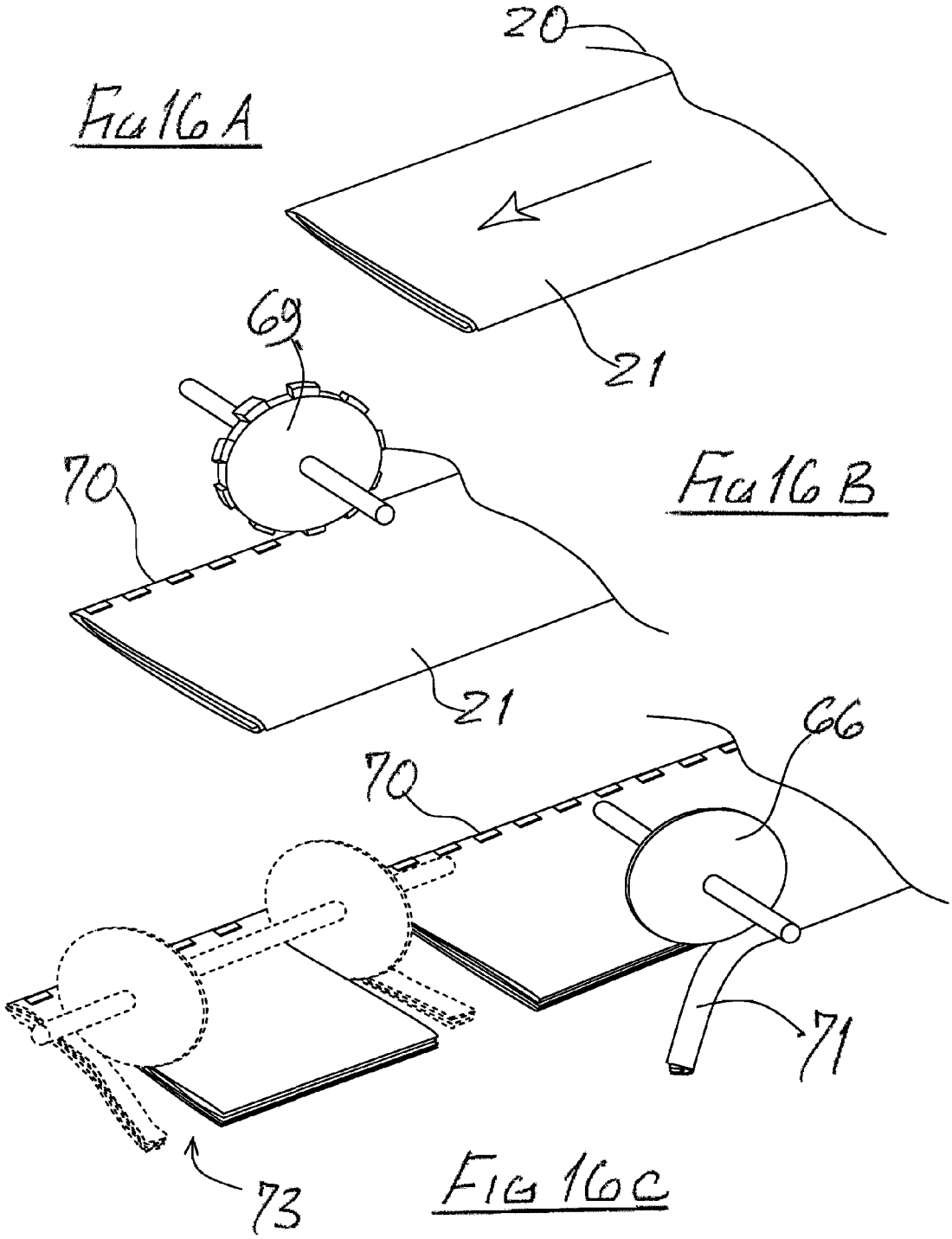
FIGS. 16A to 16C show three production steps for converting a leaflet produced by the apparatus to a booklet.

FIGS. 16A to 16C show an alternative conversion process for a leaflet produced as described above, to form a booklet. Adhesive is applied during the winding step as described with reference to FIGS. 14 and 15A to 15E. Then, on leaving the further roller nip 20 (FIG. 16A), the leaflet passes under a heated toothed wheel 69 (FIG. 16B), which applies pressure to one edge margin 70 of the leaflet, thereby causing the adhesive to bond together the various sheets making up the leaflet, along that one edge margin. Then, a slitter 66 (FIG. 16C) is employed to cut away the opposed edge margin 71 and two further slitters (shown in phantom lines in FIG. 16C) cut through the edge margins adjacent to margin 71, to produce an openable booklet.

The method of FIGS. 16A to 16C may be used with a plastic-based sheet material, in which case the glue applicator 65 may be unnecessary. Such a material may have particular advantages in terms of a relatively small thickness with high strength, coupled with a relatively slippery finish allowing the sheets to slide over one another in the course of the winding operation. Then, if a booklet is to be formed, the process steps of FIGS. 16A to 16C may be employed, with the heated toothed wheel 69 serving locally to compress and heat the plastic material sheet and so fuse together the individual leaves which will make up the booklet, along the spine thereof.

Though the embodiments of the invention described above have employed individual cut sheets, it would be possible to employ a web which has been pre-printed repeatedly with the required information, in the appropriate areas of the web, and which has then been spooled ready for the performance of the methods of this invention. Such a web may be processed as described above, but with the web being guillotined into appropriate lengths in the course of the winding operation around the mandrel such that individual leaflets are removed from the mandrel. Depending upon the thickness of the sheet material and the number of individual areas required to make up the leaflet, it may be possible to produce two or even more leaflets in one winding operation, the leaflets then being cut into individual leaflets following the compression step after winding has been completed.

The invention claimed is:

1. Apparatus for producing a leaflet from a sheet, comprising:

a mandrel having an axis and outer surface of generally elliptical cross-sectional shape, the mandrel being mounted for rotation about said axis;

a gripper provided on the mandrel to hold a leading end portion of a pre-printed sheet fed to the mandrel;

a drive arrangement to effect rotation of the mandrel about said axis so that a gripped sheet is completely wound around the outer surface of the mandrel as the mandrel is rotated by the drive arrangement;

an extractor for separating the mandrel and the sheet wound therearound from each other, wherein the extractor is disposed on opposed sides of the mandrel and is arranged to contact a sheet wound therearound, the extractor being configured to separate the wound sheet from the mandrel; and a compression arrangement to compress the extracted wound sheet into a substantially flat leaflet.

2. Apparatus as claimed in claim 1, wherein the pre-printed sheet is pre-folded along at least one crease-line extending parallel to the direction of feeding of the sheet towards the mandrel, for holding by the gripper.

3. Apparatus as claimed in claim 2, wherein the pre-printed sheet is fan-folded with at least two creases both extending parallel to the direction of feeding of the sheet.

4. Apparatus as claimed in claim 2, wherein a further compression arrangement is provided, to compress the sheet along the crease-line before the sheet is wound around the mandrel.

5. Apparatus as claimed in claim 4, wherein said further compression arrangement comprises a roller nip.

6. Apparatus as claimed in claim 1, wherein the mandrel has a slot formed therein and into which the leading edge of a sheet is fed, said slot extending diametrically though the mandrel.

7. Apparatus as claimed in claim 6, wherein the gripper is provided within said slot.

8. Apparatus as claimed in claim 7, wherein the gripper comprises a gripper element mounted within the mandrel to one side of the slot and which is moveable towards the other side of the slot thereby to grip a sheet received in the slot.

9. Apparatus as claimed in claim 1, wherein the mandrel has a first part of generally semi-elliptical shape and a second part aligned with the first part and of a modified semi-elliptical shape.

10. Apparatus as claimed in claim 1, wherein the extractor includes a pair of belts disposed on opposed sides of the mandrel and arranged to contact a sheet being wound around the mandrel, the belts being configured to pull the wound sheet away from the mandrel.

11. Apparatus as claimed in claim 10, wherein the belts define a narrowing gap therebetween whereby a wound sheet removed from the mandrel is compressed thereby as the wound sheet is advanced by movement of the belts.

12. Apparatus as claimed in claim 1, wherein the extractor includes a pair of belts disposed on opposed sides of the mandrel and arranged to contact a sheet being wound around the mandrel, the belts being configured to hold the wound sheet as the mandrel is withdrawn axially away from the sheet wound sheet as that sheet is held by said belts.

13. Apparatus as claimed in claim 1, wherein the compression arrangement includes a roller nip having a pair of rollers between which the wound sheet is advanced.

14. Apparatus as claimed in claim 1, wherein there is provided means to apply adhesive to the free end of the wound sheet to adhere that free end to the body of the leaflet.

15. Apparatus as claimed in claim 1, wherein a glue applicator is disposed adjacent the mandrel, said applicator being located to contact a part of a sheet being wound around the mandrel which part overlies the elliptical outer surface of the mandrel furthest from the axis of rotation thereof.

16. Apparatus as claimed in claim 15, wherein a slitter is arranged to remove an edge region of the glued formed leaflet thereby to produce a leaflet in a booklet form.

17. Apparatus as claimed in claim 1, wherein a mechanical joiner is provided to operate along one folded edge of the compressed leaflet and a slitter is provided to operate on the opposed folded edge of the compressed leaflet, thereby to produce a leaflet in a booklet form.

18. Apparatus as claimed in claim 17, wherein the mechanical joiner applies heat and pressure to said one edge of the folded leaflet, thereby to bond together the sheets thereof along said one edge of the compressed leaflet.

19. A method of producing a leaflet from a pre-printed sheet, comprising the steps of:

feeding the sheet to a mandrel having an outer surface of generally elliptical cross-sectional shape and a gripper associated therewith;

using the gripper to hold to the mandrel a leading edge of a fed sheet;

rotating the mandrel about the axis thereof so as thereby to wind the fed sheet completely around the outer surface of the mandrel;

separating the mandrel and a sheet wound therearound from each other, wherein the wound sheet is separated from the mandrel by an extractor disposed one to each side of the mandrel and arranged to contact the sheet wound therearound; and compressing the wound sheet into a substantially flat leaflet.

20. A method as claimed in claim 19 and in which the mandrel has a slot extending thereinto from the mandrel outer surface, wherein the leading edge of the sheet is fed into the slot and the holding of the leading edge is performed within the slot.

21. A method as claimed in claim 19, wherein the sheet is pre-folded along at least one crease-line extending parallel to the direction of advancement of the sheet towards the mandrel.

22. A method as claimed in claim 21, wherein the sheet is fan-folded with at least two creases both extending parallel to the direction of feeding of the sheet towards the mandrel.

23. A method as claimed in claim 22, wherein the sheet is compressed along the or each crease-line before the sheet is wound around the mandrel.

24. A method as claimed in claim 19, wherein the extractor is a pair of power-driven belts and the wound sheet is removed from the mandrel by the pair of power-driven belts disposed one to each side of the mandrel and arranged to contact a sheet wound therearound, the belts being arranged to pull the wound sheet away from the mandrel.

25. A method as claimed in claim 24, wherein the pair of belts define a narrowing gap therebetween so that the wound sheet is compressed thereby as the wound sheet is advanced between the belts by the movement thereof.

26. A method as claimed in claim 19, wherein glue is applied to the sheet in the course of being wound around the mandrel so that subsequent to compressing the wound sheet into a substantially flat leaflet and the removal of an edge of the compressed leaflet, a booklet is formed thereby.

27. A method as claimed in claim 26, wherein the glue is applied across the mandrel in alignment with a part thereof furthest from the axis of rotation of the mandrel.

28. A method as claimed in claim 19, wherein following the compression of the leaflet, a mechanical joining operation is performed along one folded edge of the compressed leaflet and a slitting operation is performed on the opposed folded edge of the compressed leaflet, thereby to produce a leaflet in a booklet form.

29. A method as claimed in claim 19, wherein the mechanical joining applies heat and pressure to said one edge of the folded leaflet, thereby to bond together the sheets thereof along said one edge of the compressed leaflet.

30. A method as claimed in claim 29, wherein a slitting operation is performed on the folded edge of the sheet opposed to said one edge thereby to produce a leaflet in booklet form.

31. A method as claimed in claim 30, wherein a slitting operation is performed along the two edges of the sheet, adjacent said one edge, thereby to produce a leaflet in openable booklet form.

* * * * *